US006705899B1

(12) United States Patent
Ji

(10) Patent No.: US 6,705,899 B1
(45) Date of Patent: Mar. 16, 2004

(54) CABLE END CONNECTOR HAVING IMPROVED SHELL STRUCTURE

(75) Inventor: RenHua Ji, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/330,778

(22) Filed: Dec. 26, 2002

(51) Int. Cl.[7] ..... H01R 17/00
(52) U.S. Cl. ..... 439/660
(58) Field of Search ..... 439/610, 607, 439/608, 609, 680, 352

(56) References Cited

U.S. PATENT DOCUMENTS 5,934,942 A * 8/1999 Patel et al. ..... 439/610
5,941,725 A 8/1999 Brennan et al.
6,071,141 A * 6/2000 Semmeling et al. ..... 439/353
6,162,086 A * 12/2000 Kuo ..... 439/497
6,210,220 B1 * 4/2001 Zhu et al. ..... 439/567
6,290,530 B1 * 9/2001 Chang ..... 439/378
6,319,040 B1 * 11/2001 Chang ..... 439/352
6,524,135 B1 * 2/2003 Feldman et al. ..... 439/610
6,607,397 B1 * 8/2003 Zhang et al. ..... 439/357

* cited by examiner

*Primary Examiner*—Gary Paumen
*Assistant Examiner*—Phuongchi Nguyen
(74) *Attorney, Agent, or Firm*—Wei Te Chung

(57) ABSTRACT

A cable end connector (1) for assembling with a cable comprises a dielectric housing (10) secured a plurality of terminals (20) therewithin, an upper and a lower shells (40, 50) enclosing the housing, and an upper and a lower covers (60, 70) enclosing the upper and lower shells. The housing includes a main body (100) and a tongue portion (101) projecting forwardly from the main body. The upper shell has an upper projecting lip (401) abutting against an upper surface of the tongue. The lower shell has a lower projecting lip (501) abutting against a lower surface of the tongue portion. The upper and lower projecting lips respectively has a pair of upper and lower engaging portions (409, 509) disposed on opposite side edges thereof. The upper and lower engaging portions abut against opposite side surfaces of the tongue portion, and engage with each other at same time.

1 Claim, 5 Drawing Sheets

CABLE END CONNECTOR HAVING IMPROVED SHELL STRUCTURE

BACKGROUND OF THE INVENTION

1. Field of the Invention

This invention relates to a cable end connector, and more particularly to a cable end connector having improved interlocked shell structures so as to prevent the shell from wrapping-up which consequently blocks the intermating between the connectors.

2. Description of Related Art

In high speed data transmitting environment, it is important to shield the signal conductors at a connection interface to prevent Electro Magnetic Interference (EMI) exposed thereon thereby deteriorating the signals transmitted therethrough. Accordingly, shielded cable end connectors have been designed to meet the requirement. Such a conventional cable end connector is, for example, typically disclosed in U.S. Pat. Nos. 5,941,725 and 5,934,942. The cable end connector includes an inner dielectric housing having a plurality of terminals secured therewithin, an upper and a lower conductive shells, and an outer dielectric housing enclosing the upper and lower conductive shells. The upper and lower conductive shells enclose the inner dielectric housing therein to provide a full shielding environment. However, a front portion of the upper and lower conductive shells are merely abut against an upper and a lower surfaces of the inner dielectric housing without fixture to fixedly attach to the inner dielectric housing, so the front portion of the upper and lower conductive shells have a possibility to wrap up which consequently blocks the intermating between the cable end connector and a mating connector.

Hence, an improved cable end connector is required to overcome the disadvantages of the prior art.

SUMMARY OF THE INVENTION

An object of the present invention is to provide a cable end connector having an improved shell.

To fulfill the above-mentioned object, a cable end connector according to the present invention for assembling with a cable comprises a dielectric housing having a plurality of terminals secured therewithin, an upper and a lower shells enclosing the housing, and an upper and a lower covers enclosing the upper and lower shells. The dielectric housing includes a main body and a tongue portion projecting forwardly from the main body. The upper shell has an upper main wall abutting against an upper surface of the main body of the dielectric housing and an upper projecting lip abutting against an upper surface of the tongue portion of the dielectric housing. The lower shell has a lower main wall abutting against a lower surface of the main body of the dielectric housing and a lower projecting lip abutting against a lower surface of the tongue portion of the dielectric housing. The upper and lower projecting lips respectively has a pair of upper and lower engaging portions disposed on opposite side edges thereof. The pair of upper and lower engaging portions abut against opposite side surfaces of the tongue portion, and the pair of upper and lower engaging portions engage with each other.

In this design, the upper and lower projecting lips of the upper and lower conductive shells respectively has a pair of upper and lower engaging portions disposed on opposite side edges thereof, the upper and lower projecting lips are fixed on the dielectric housing via the upper and lower engaging portions engaging with each other, the upper and lower projecting lips have no risk to wrap which ensure the cable end connector mate with a mating connector.

Other objects, advantages and novel features of the invention will become more apparent from the following detailed description when taken in conjunction with the accompanying drawings.

DETAILED DESCRIPTION OF THE INVENTION

Figure 1:
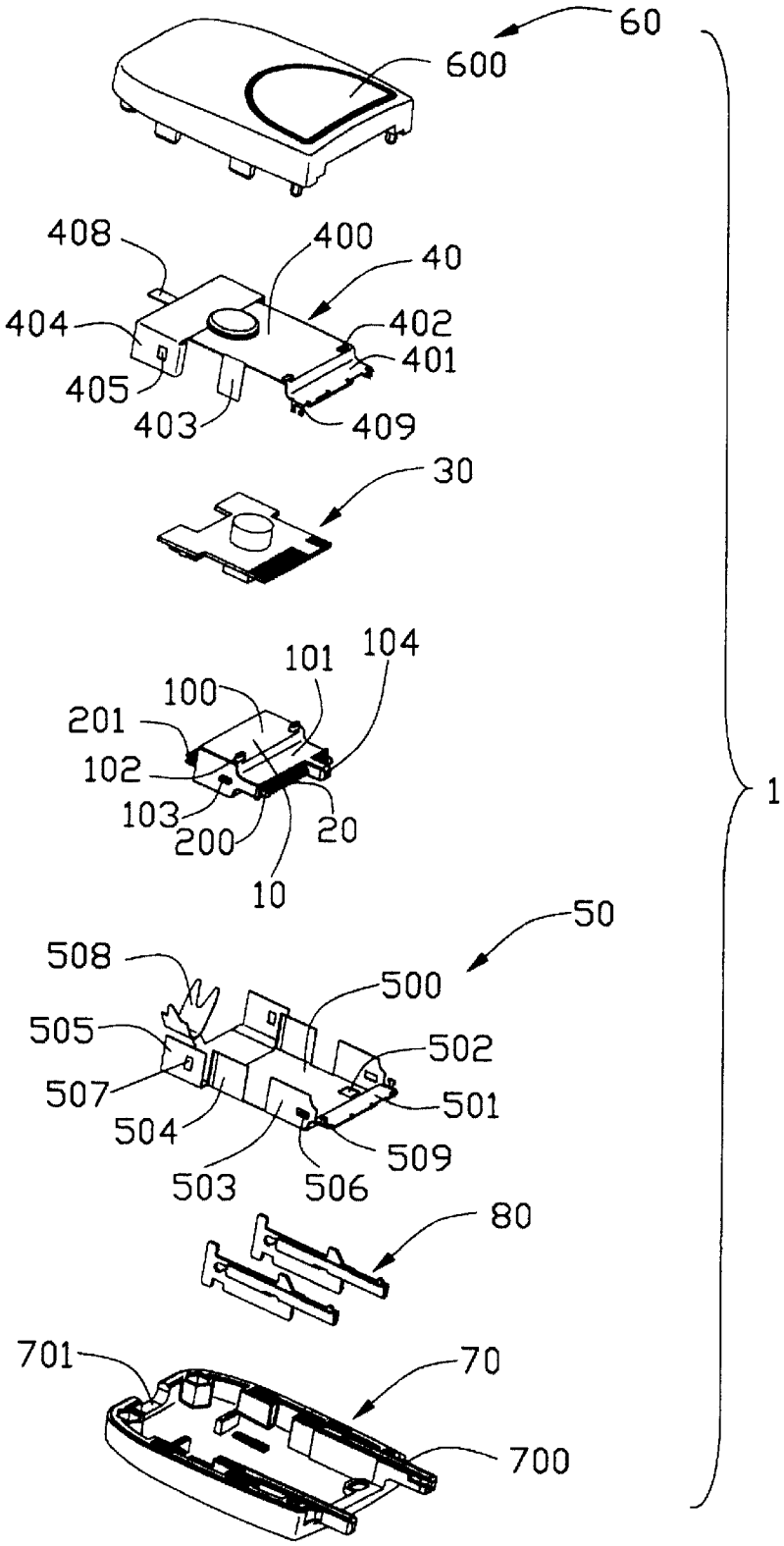
FIG. 1 is an exploded view of a cable end connector according to the present invention.
Figure 2:
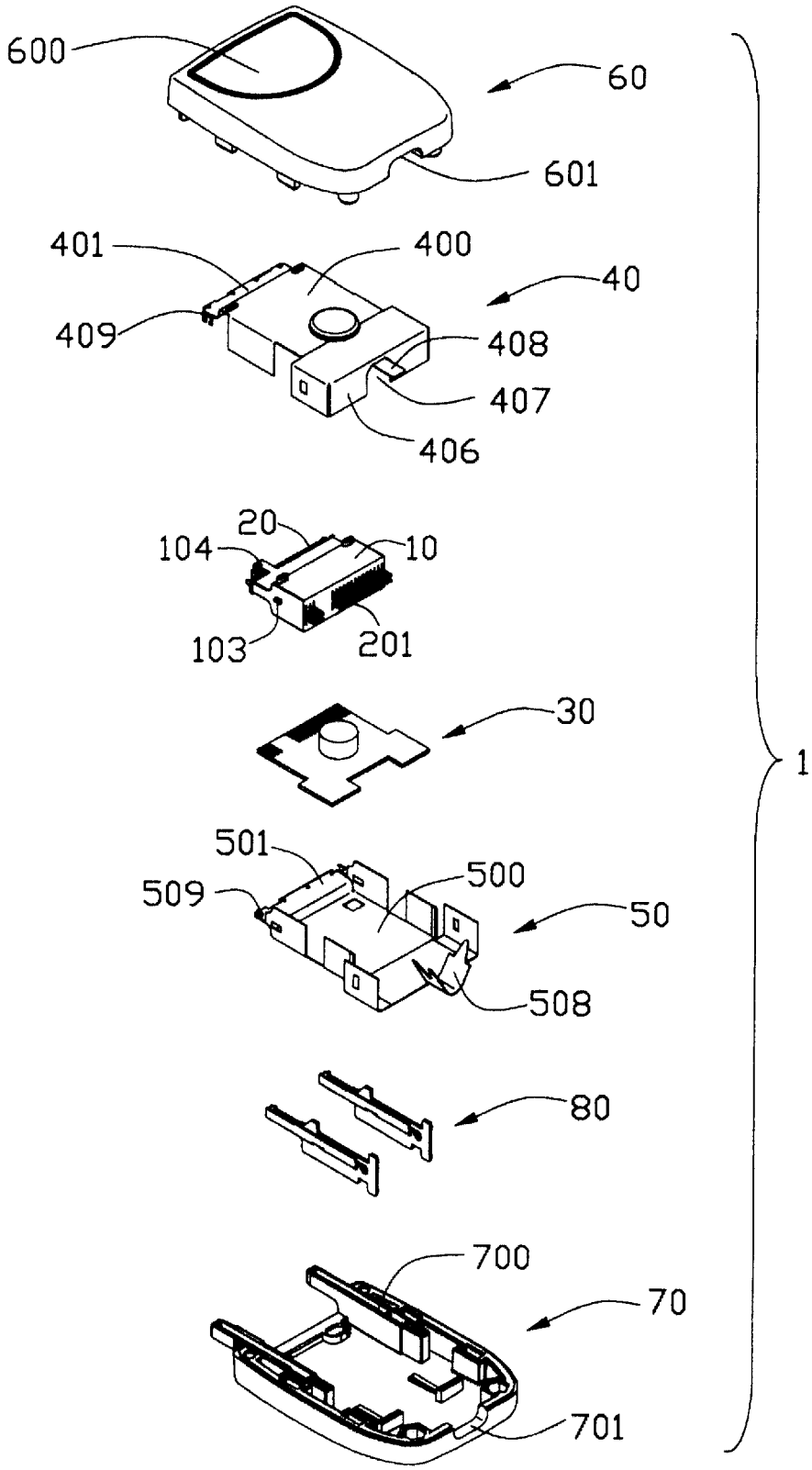
FIG. 2 is another exploded view of the cable end connector in FIG. 1.

Referring to FIG. 1 and FIG. 2, a cable end connector 1 according to the present invention comprises a dielectric housing 10 securing a plurality of terminals 20 therewithin, a PCB 30, an upper and a lower conductive shells 40, 50, an upper and a lower covers 60, 70, and a pair of latches 80.

The dielectric housing 10 includes a main body 100 and a tongue portion 101 extending forwardly from the main body 100. A plurality of terminal channels 102 run through the front-to-end of the dielectric housing 10 for receiving the terminals 20. Two pairs of locating poles 103 are respectively disposed on an upper and a lower surface of the main body 10. The main body 10 further has a pair of position poles 104 protruded on opposite side surfaces. The tongue portion 101 has a separated pole in a front surface thereof for separating power terminals and data terminals.

Each terminal 20 includes a contact portion 200 extending beyond the front surface of the tongue portion 101 of the dielectric housing 10 for contacting with terminals of a mating connector (not shown), and a solder portion 201 extending beyond a rear surface of the main body 100 of the dielectric housing 10 for soldering with the PCB 30. The PCB 30 has a plurality of electric components (not labeled) disposed thereon for performing the power transmission and data exchanging functions.

The upper shell 40 is made from a metal plate, includes an upper main wall 400 and an upper projecting lip 401 extending from a front edge of the upper main wall 400. The upper main wall 400 has a pair of upper locating holes 402 in a front thereof. A pair of upper-front side walls 403 and a pair of upper-rear side walls 404 are bending disposed from opposite side edges of the upper main wall 400. Each upper-rear side wall 404 has a of block orifice 405 defined therein. The upper main wall 400 bending disposed a pair of rear walls 406 on a rear edge thereof. A gap 407 formed between the two rear walls 406 to allow a cable end (not shown) run through and sold with the PCB 30. A rear piece 408 adjacent with the gap 407 rearwardly extends from the upper main wall 400. The upper projecting lip 401 has a pair of upper engaging portions 409 disposed on opposite sides thereof. In the present embodiment, the upper engaging portion 409 is a wing having a T-shaped groove.

The lower shell 50 is made from a metal plate also, includes a lower main wall 500 and an lower projecting lip 501 extending from a front edge of the lower main wall 500. The lower main wall 500 has a pair of lower locating holes 502 in a front thereof. A pair of lower-front side walls 503, a pair of lower-middle side walls 504, and a pair of lower-rear side walls 505 are bending disposed from opposite side edges of the lower main wall 500. Each lower-front side wall 503 has a position hole 506 defined therein. Each lower-rear side wall 505 has a block piece 507 defined therein. A crimp 508 rearwardly extends from the lower main wall 500. The lower projecting lip 501 has a pair of lower engaging portions 509 disposed on opposite sides thereof. In the present embodiment, the lower engaging portion 509 is a T-shaped wing.

The lower cover 70 has a pair of receiving slots 700 defined in opposite sides thereof for receiving the pair of latches 80. A lower semicircular groove 701 is depressed on a rear portion of the lower cover 70. The upper cover 60 has a press button 600 for actuating the latches 80 to release the cable end connector 1 from engagement with a mating connector. An upper semicircular groove 601 is depressed on a rear portion of the upper cover 60.

Figure 3:
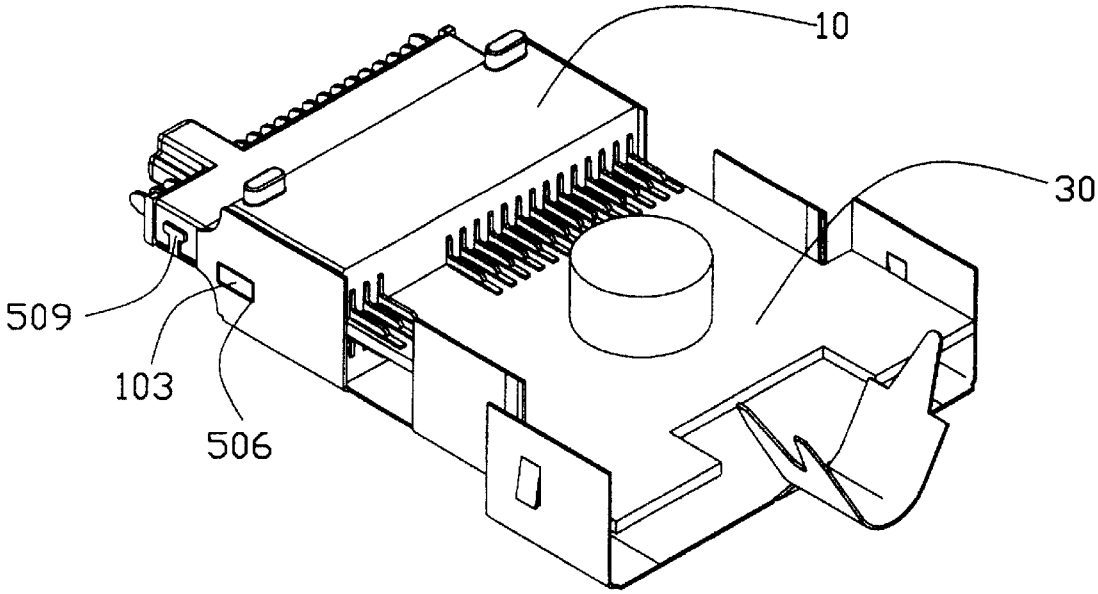
FIG. 3 is a part perspective view of the cable end connector in FIG. 1, which includes a dielectric housing securing a plurality of terminals, a printed circuit board (PCB), and a lower conductive shell.
Figure 4:
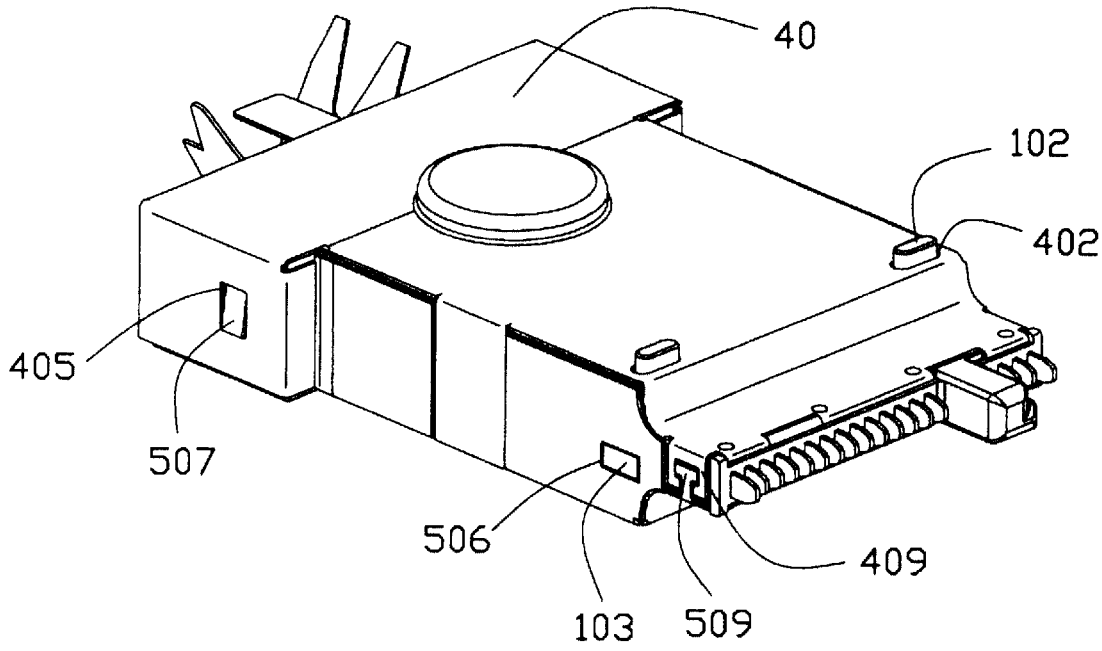
FIG. 4 is another part perspective view of the cable end connector in FIG. 1, which includes a dielectric housing securing a plurality of terminals, a PCB, an upper and a lower conductive shell.
Figure 5:
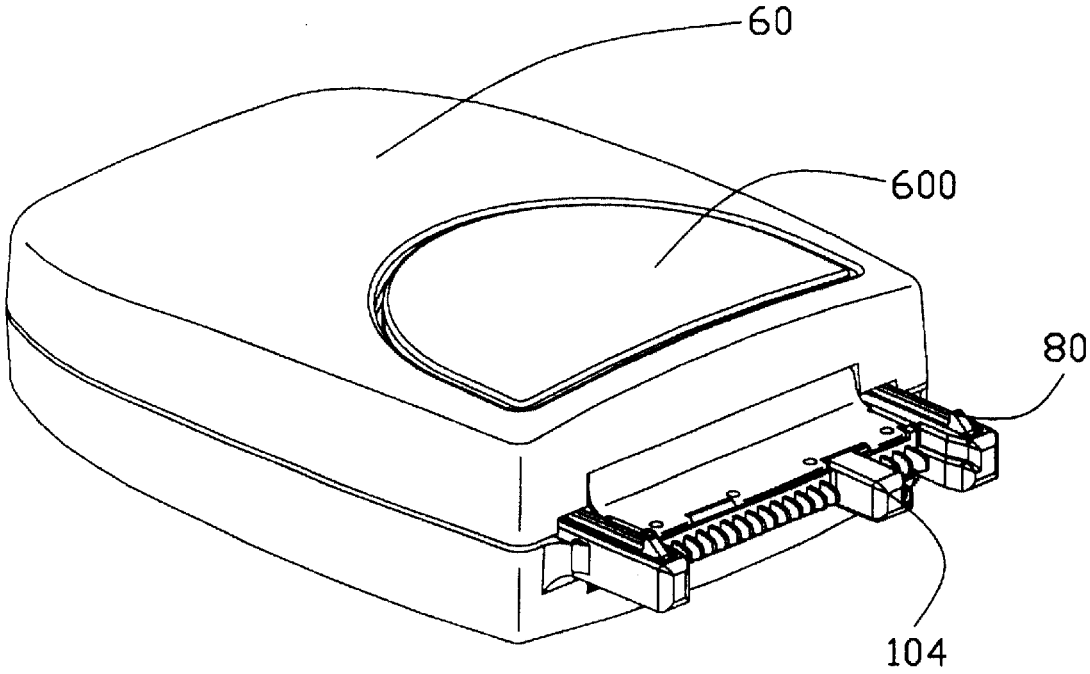
FIG. 5 is a perspective view of the cable end connector in FIG. 1.

Referring to FIG. 3 to FIG. 5, in assembly, the PCB 30 is soldered with the solder portion 201 of the terminals 20. The upper and lower conductive shells 40, 50 are assembled together to enclose the dielectric housing 10 and the PCB 30 therein for providing a full shielding environment. The upper main wall 400 and the upper projecting lip 401 of the upper shell 40 respectively abut against the upper surface of the main body 100 and the tongue 101 of the dielectric housing 10. The pair of locating poles 102 on the upper surface of the main body 100 of the dielectric housing 10 are located in the pair of upper locating holes 402 on the upper main wall 400 of the upper shell 40. The lower main wall 500 and the lower projecting lip 501 of the lower shell 50 respectively abut against the lower surface of the main body 100 and the tongue 101 of the dielectric housing 10. The pair of locating poles 102 on the lower surface of the main body 100 of the dielectric housing 10 are located in the pair of lower locating holes 502 on the lower main wall 500 of the lower shell 50. The pair of lower-front side walls 503 of the lower shell 50 abut against opposite side surfaces of the main body 100 of the dielectric housing 10. The position poles 103 on the opposite side surfaces of the main body 100 of the dielectric housing 10 are positioned in the position holes 506 of the lower-front side walls 503 on the lower shell 50. The pair of upper and lower engaging portions 409, 509 of the upper and lower shells 40, 50 abut against opposite side surfaces of the tongue portion 101 of the dielectric housing 10. The pair of upper and lower engaging portions 409, 509 engage with each other. In addition, the block pieces 507 on the lower-rear side walls 505 of the lower shell 50 are blocked in the block orifices 405 on the upper-rear side walls 404 of the upper shell 40. The rear piece 408 of the upper shell 40 and the crimp 508 of the lower shell 50 work together to secure the cable end. The upper and lower covers 60, 70 enclose the upper and lower shells 40, 50. The upper and the lower semicircular grooves 601, 701 form a circular aperture which allow the cable end to run through.

Compared to the prior art, the upper and lower projecting lips 401, 501 of the upper and lower conductive shells 40, 50 according to the present invention respectively has a pair of upper and lower engaging portions 409, 509 disposed on opposite side edges thereof, the upper and lower projecting lips 401, 501 are fixed on the dielectric housing 10 via the upper and lower engaging portions 409, 509 engaging with each other, the upper and lower projecting lips 401, 501 have no risk to wrap which ensure the cable end connector 1 mate with a mating connector.

It is to be understood, however, that even though numerous characteristics and advantages of the present invention have been set forth in the foregoing description, together with details of the structure and function of the invention, the disclosure, is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector for assembling with a cable, comprising:

a dielectric housing having a plurality of terminals secured therein, and including a main body with a tongue portion projecting forwardly therefrom;

an upper shell assembled to the housing and a lower shell assembled to the housing corresponding to the upper shell;

an upper and a lower covers enclosing the upper and lower shells; and interlocking means arranged between an upper and a lower projecting lips of the upper and lower shells thereby preventing the projecting lips from wrapping up during the mating;

wherein the interlocking means are a pair of upper and lower engaging portions which are respectively disposed on opposite side edges of the upper and lower projecting lips;

wherein the upper engaging portion is a wing having a T-shaped groove, and the lower engaging portion is a T-shaped wing;

wherein the upper and lower projecting lips abut against an upper and a lower surface of the tongue portion of the dielectric housing, and the pair of upper and lower engaging portions abut against opposite side surfaces of the tongue portion of the housing;

wherein the upper shell includes an upper main wall with an upper projecting lip extending forwardly therefrom, and the lower shell includes a lower main wall with an lower projecting lip extending forwardly therefrom;

wherein the dielectric housing has two pairs of locating poles respectively disposed on the upper and lower surface of the main body, while the upper and lower shell respectively has a pair of upper and lower locating holes respectively disposed on the upper and lower main wall, and the locating poles are located in the upper and lower locating holes;

wherein the upper shell has a pair of upper-front sidewalk and a pair of upper-rear sidewalls bending disposed on opposite side edges of the upper main wall;

wherein the lower shell has a pair of lower-front sidewalk, a pair of lower-middle sidewalk, and a pair of lower-rear sidewalk bending disposed on opposite side edges of the lower main wall, wherein the pair of lower-front sidewalk are abutting against opposite side surfaces of the main body of the dielectric housing;

wherein the lower shell has a pair of position holes disposed on the lower-rear sidewall thereof, the dielectric housing has a pair of position poles disposed on opposite side surfaces of the main body thereof, the position poles are positioned in the position holes;

wherein each upper shell has a block orifice disposed thereon, each lower shell has a block piece disposed thereon, the block pieces are blocked in the block orifices;

wherein a pair of rear walls with a gap formed therebetween are bending disposed on rear edge of the upper main wall the upper shell;

wherein the upper shell has a rear piece rearwardly extending from the rear edge of the upper main wall, while the lower shell has a crimp rearwardly extending from a rear edge of the lower main wall thereof, and the rear piece and the crimp work together to secure a cable end;

wherein the cable end connector further comprises a PCB soldered with the terminals and enclosed by the upper and lower shells;

wherein the cable end connector further comprises a pair of latches secured in opposite sides of the lower cover;

wherein the upper cover has a press button for actuating the pair of latches.

* * * * *